US008158840B2

(12) United States Patent
Spicer

(10) Patent No.: US 8,158,840 B2
(45) Date of Patent: Apr. 17, 2012

(54) PROCESS AND APPARATUS FOR COOLING LIQUID BOTTOMS FROM VAPOR/LIQUID SEPARATOR DURING STEAM CRACKING OF HYDROCARBON FEEDSTOCKS

(75) Inventor: David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 563 days.

(21) Appl. No.: 12/132,130

(22) Filed: Jun. 3, 2008

(65) Prior Publication Data

US 2009/0030254 A1 Jan. 29, 2009

Related U.S. Application Data

(60) Provisional application No. 60/962,034, filed on Jul. 26, 2007.

(51) Int. Cl.
*C07C 4/06* (2006.01)

(52) U.S. Cl. ..... 585/634; 585/648; 585/650; 585/652; 208/48 R; 208/80; 208/92; 208/113; 208/125; 208/132; 165/115; 165/118

(58) Field of Classification Search ..... 585/634, 585/648, 650, 652; 208/48 R, 125, 80, 92, 208/113, 132; 165/115, 118
See application file for complete search history.

(56) References Cited

U.S. PATENT DOCUMENTS 3,647,907 A 8/1969 Sato et al.
3,593,968 A 7/1971 Geddes
3,617,493 A 11/1971 Wirth
3,907,661 A 9/1975 Gwyn et al.
3,959,420 A 5/1976 Geddes et al.
4,107,226 A 8/1978 Ennis, Jr. et al.
4,121,908 A 10/1978 Raab et al.
4,233,137 A 11/1980 Ozaki et al.
4,279,734 A 7/1981 Gwyn
4,444,697 A 4/1984 Gater et al.
4,614,229 A 9/1986 Oldweiler
6,626,424 B2 9/2003 Ngan et al.
6,632,351 B1 10/2003 Ngan et al.
2004/0004022 A1 1/2004 Stell et al.
2005/0209495 A1 9/2005 McCoy et al.
2006/0089519 A1 * 4/2006 Stell et al. ..... 585/648

FOREIGN PATENT DOCUMENTS

GB 1 233 795 5/1971

OTHER PUBLICATIONS

Hermann et al., Latest Developments in Transfer Line Exchanger Design for Ethylene Plants, AIChE Spring National Meeting, Atlanta, Georgia, Apr. 1994, pp. 193-220.

* cited by examiner

*Primary Examiner* — Prem C Singh

(57) ABSTRACT

A process and apparatus for steam cracking liquid hydrocarbon feedstocks utilizes a vapor/liquid separation apparatus to treat heated vapor/liquid mixtures to provide an overhead of reduced residue content and includes: i) indirectly heat exchanging liquid bottoms with boiler feed water to provide cooled liquid bottoms and preheated boiler feed water; ii) directing at least a portion of said preheated boiler feed water to a steam drum; and iii) recovering steam having a pressure of at least about 4100 kPa (600 psia) from said steam drum.

22 Claims, 1 Drawing Sheet

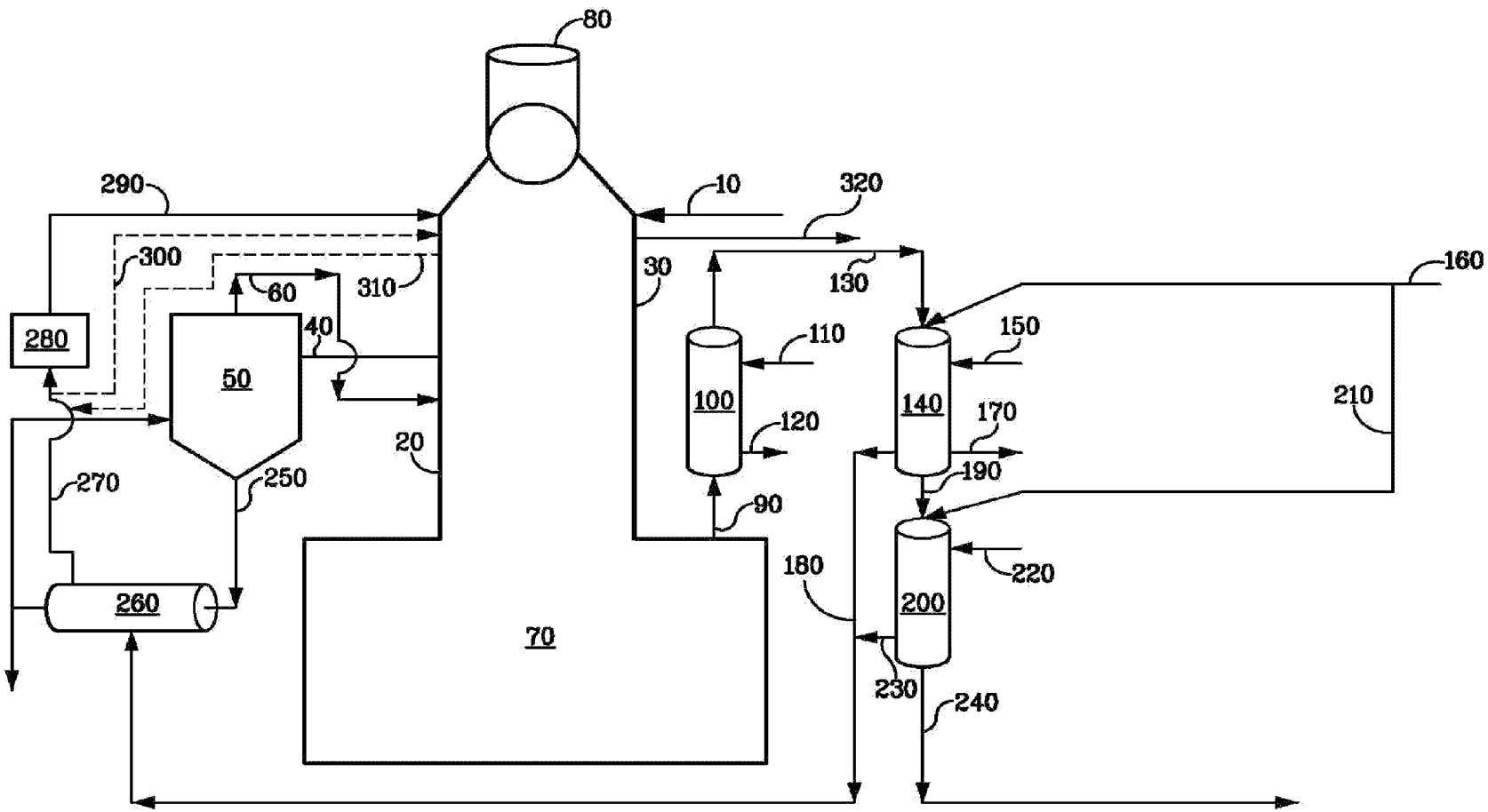
160
210
150
170
190
220
240
140
200
230
320
130
110
120
180
90
100
10
30
80
70
20
310
40
60
50
250
290
300
260
270
280

PROCESS AND APPARATUS FOR COOLING LIQUID BOTTOMS FROM VAPOR/LIQUID SEPARATOR DURING STEAM CRACKING OF HYDROCARBON FEEDSTOCKS

RELATIONSHIP TO OTHER APPLICATIONS

This application claims benefit of U.S. provisional application Ser. No. 60/962,034, filed Jul. 26, 2007.

FIELD OF THE INVENTION

The present invention relates to cracking hydrocarbons from feedstock containing relatively non-volatile hydrocarbons. In particular, the present invention relates to improved recovery of furnace heat energy and cooling liquid bottoms taken from a vapor/liquid separation apparatus used in steam cracking hydrocarbon feeds by heat exchange with boiler feed water, preferably boiler feed water useful in generation of high pressure steam.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace with two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products leave the pyrolysis furnace for further downstream processing, including quenching.

Quenching effluent from a heavy feed cracking furnace has been technically challenging. Most modern heavy feed furnaces employ a two-stage quench, the first stage being a high pressure 10340 to 13800 kPa (1500-2000 psia) steam generator and the second stage utilizing direct oil quench injection. See, e.g., U.S. Pat. No. 3,647,907 to Sato et al., incorporated herein by reference. In the 1960's high pressure steam generating cracked gas coolers deployed as transfer line exchangers were found to be especially useful in cracking liquid feeds. The high steam pressure (8100 to 12200 kPa (80 to 120 bar)) and high tube wall temperatures (300° C. to 350° C.) limited the condensation of heavy hydrocarbons and attendant coke formation on tube surfaces. Typically, boiler feed water preheating is effected within the convection section of the furnace.

Conventional steam cracking systems have been effective for cracking high-quality feedstocks such as gas oil and naphtha. However, steam cracking economics sometimes favor cracking lower cost heavy feedstock such as crude oil and atmospheric resid, also known as atmospheric pipestill bottoms. Crude oil and atmospheric resid contain high molecular weight, non-volatile components with boiling points in excess of 590° C. (1100° F.). The non-volatile, heavy ends of these feedstocks may lay down as coke in the convection section of conventional pyrolysis furnaces. Only very low levels of non-volatiles can be tolerated in the convection section downstream of the point where the lighter components have fully vaporized. Additionally, some naphthas are contaminated with crude oil during transport. Conventional pyrolysis furnaces do not have the flexibility to process resids, crudes, or many resid or crude contaminated gas oils or naphthas that contain a large fraction of heavy non-volatile hydrocarbons.

The present inventor has recognized that in using a flash to separate heavy non-volatile hydrocarbons from the lighter volatile hydrocarbons which can be cracked in the pyrolysis furnace, it is important to maximize the non-volatile hydrocarbon removal efficiency. Otherwise, heavy, coke-forming, non-volatile hydrocarbons could be entrained in the vapor phase and carried overhead into the furnace creating coking problems in the convection section. It has also been recognized that the heated liquid bottoms produced from such flashing typically must be cooled, thereby providing an opportunity to enhance thermal efficiency of the steam cracking process.

U.S. Pat. No. 4,233,137, which is fully incorporated herein by reference, discloses a quench exchanger system which recovers heat from pyrolysis furnace cracked effluent in the form of high pressure steam by direct oil quench to 300° C.-400° C., followed by indirect heat exchange of the effluent/oil mixture in a shell-and-tube exchanger to transfer the heat into a high pressure water to obtain high pressure steam (40 to 100 kg/cm$^2$).

U.S. Pat. No. 3,617,493, which is fully incorporated herein by reference, discloses the use of an external vaporization drum for the crude oil feed and discloses the use of a first flash to remove naphtha as vapor and a second flash to remove vapors with a boiling point between 230° C. (450° F.) and 590° C. (1100° F.). The vapors are cracked in the pyrolysis furnace into olefins and the separated liquids from the two flash tanks are removed, stripped with steam, and used as fuel.

Co-pending U.S. Publication No. 2004/0004022 A1, which is incorporated herein by reference, describes an advantageously controlled process to optimize the cracking of volatile hydrocarbons contained in the heavy hydrocarbon feedstocks, and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water. The bottoms from the flash can be cooled.

U.S. patent application Ser. No. 60/555,282, filed Mar. 22, 2004, which is incorporated herein by reference, teaches the use of steam generating quench exchangers with a furnace which includes a convection section vapor/liquid separator for removing non-volatiles from heavy feedstock. A steam superheating bank in the convection section can be located between a) the outlet for partially vaporized feed from the convection section before the vapor/liquid separator, and b) the inlet for reintroducing vapor to the convection section from the vapor/liquid separator.

It is known to produce high pressure steam from pyrolysis effluent using quench exchangers. U.S. Pat. No. 4,614,229, incorporated herein by reference, utilizes a primary non-liquid washed steam superheating transfer line exchanger and a secondary liquid washed transfer line exchanger steam generator to generate 10400 kPa (1500 psia) steam.

In using a flash to separate heavy liquid hydrocarbon fractions containing resid from the lighter fractions, which can be processed in the pyrolysis furnace, it is important to effect the separation so that most of the non-volatile components will be in the liquid phase. Otherwise, heavy, coke-forming, non-volatile components in the vapor are carried into the furnace causing coking problems.

During flashing to separate heavy liquid hydrocarbon fractions containing resid from the lighter fractions, which can be processed in the pyrolysis furnace, it would be desirable to cool the liquid bottoms fraction in such a way as to efficiently recover their heat. Accordingly, it would be desirable to provide a process for cooling liquid phase materials, e.g., bottoms taken from a flash drum used to separate heavy liquid hydrocarbon fractions containing resid from the lighter fractions, which can be processed in the pyrolysis furnace, while utilizing transferred heat to efficiently integrate the heat recovery in the overall furnace design.

SUMMARY OF THE INVENTION

In one aspect, the present invention relates to a process for cooling liquid bottoms from a vapor/liquid separation apparatus used in steam cracking a hydrocarbon feedstock, which comprises: i) indirectly heat exchanging the liquid bottoms with a boiler feed water to provide cooled liquid bottoms and heated boiler feed water; and ii) recovering steam having a pressure of at least about 4100 kPa (600 psia) (high pressure steam). Preferably, the invention also includes the intermediate step of directing at least a portion of the heated boiler feed water to a steam drum for production of the recovered steam, preferably high pressure steam. In preferred embodiments, the boiler feed water includes boiler feed water that feeds water to the high pressure steam system. The high pressure steam system typically includes uses of steam in cracking system components that are directly associated with the pyrolysis or cracking process, such as sparger injection into the feed to be cracked and direct or indirect quench of the cracked effluent after cracking. The steam system may also utilize high pressure steam for powering turbines or other equipment used in the fluid processing and cracking system, or otherwise recovered heat energy to the steam cracking or pyrolysis process. This is distinguished from the medium and lower pressure steam systems that typically use heat in processes that are not directly related to the pyrolysis system.

In certain embodiments of this aspect of the invention, the inventive process further comprises: i) directing the generated steam to the convection section of a pyrolysis furnace for additional heating; and ii) taking the additionally heated steam from the convection section as a superheated steam.

Embodiments of this aspect of the invention can further comprise directing at least a portion of the heated boiler feed water, preferably high pressure boiler feed water, to the convection section of a pyrolysis furnace for additional heating, after which the additionally heated boiler feed water is directed to the steam drum. The term steam drum is defined broadly herein to include substantially any apparatus or system used in the production or generation of steam and is not limited to merely a specific type of vessel, though it may typically include a steam generator or boiler.

Still other embodiments of this aspect of the invention relate to a process which further comprises recycling the cooled liquid bottoms to the vapor/liquid separation apparatus.

In another aspect, the present invention relates to a process for cracking a hydrocarbon feedstock containing resid, the process comprising: (a) heating a hydrocarbon feedstock containing resid; (b) mixing the heated hydrocarbon feedstock with steam to form a mixture stream; (c) introducing the mixture stream to a vapor/liquid separation apparatus to form i) a vapor phase of reduced resid content, and ii) a liquid phase of increased resid content, relative to the resid content of said mixture stream; (d) separately removing each of the vapor phase as overhead and the liquid phase as bottoms from the vapor/liquid separation apparatus; (e) cooling the bottoms by indirect heat exchange with boiler feed water to provide a heated boiler feed water and a cooled liquid bottoms; (f) cracking the vapor phase in a radiant section of a pyrolysis furnace to produce a cracked effluent comprising olefins, the pyrolysis furnace comprising a radiant section and a convection section; and (g) recovering steam generated using said heated boiler feed water, the recovered steam having a pressure of at least about 4100 kPa (600 psia). In one preferred aspect, the process also comprises the step of preheating the boiler feed water by quenching the cracked effluent with the boiler feed water prior to cooling the bottoms by indirect heat exchange. In another preferred embodiment, the process also includes the step of directing the provided heated boiler feed water to a steam drum after cooling the bottoms by indirect heat exchange with the boiler feed water to generate the steam in said steam drum using the boiler feed water.

In certain embodiments of this aspect of the invention, the process further comprises: i) directing the steam to the convection section of a pyrolysis furnace; and ii) recovering the steam from the convection section as a superheated high pressure steam.

Embodiments of this aspect of the invention relate to the process which further comprises directing at least a portion of the heated boiler feed water to the convection section of a pyrolysis furnace for additional heating, after which the additionally heated boiler feed water is directed to the steam drum.

Other embodiments of this aspect of the invention relate to a process that further comprises recycling the cooled bottoms to the vapor/liquid separation apparatus.

In still another aspect, the present invention relates to an apparatus for cracking a hydrocarbon feedstock containing resid, said apparatus comprising: (1) a convection heater for heating the hydrocarbon feedstock; (2) an inlet for introducing steam to the heated hydrocarbon feedstock to form a mixture stream; (3) a vapor/liquid separator for treating the mixture stream to form i) a vapor phase and ii) a liquid phase; the separator further comprising an overhead outlet for removing the vapor phase as overhead and a liquid outlet for removing the liquid phase as bottoms from the vapor/liquid separator; (4) a cooler for cooling the vapor/liquid separator bottoms by indirect heat exchange, comprising an inlet for receiving the bottoms from the separator, a bottoms outlet for withdrawing cooled bottoms from the cooler, a boiler feed water inlet for receiving boiler feed water as a heat exchange medium to the cooler, and a boiler feed water outlet for withdrawing heated boiler feed water; (5) a steam drum comprising an inlet for receiving the heated boiler feed water, an outlet for withdrawing high pressure steam, and an outlet for withdrawing boiler feed water; (6) a pyrolysis furnace comprising a radiant section for cracking the separated vapor phase to produce a cracked effluent comprising olefins, and (7) a means for quenching the cracked effluent and recovering cracked product therefrom. Preferably, the boiler feed water inlet is supplied by boiler feed water that was preheated by heat exchange in the means for quenching the effluent, such as a transfer line exchanger, and then heated by heat exchange in the cooler with the separated bottoms. The steam drum is preferably capable of providing steam of at least about 4100 kPa (600 psia) (high pressure steam) and more preferably capable of providing steam at a pressure of at least about 8270 kPa (1200 psia).

Embodiments of the apparatus of the present invention can further comprise a line for introducing high pressure steam from the steam drum to the convection section and a line from the convection section for withdrawing the high pressure steam from the convection section as superheated high pressure steam. Certain embodiments of the apparatus can further comprise a line for introducing at least a portion of the heated boiler feed water from the cooler to the convection section of the pyrolysis furnace for additional heating, and a line for introducing the additionally heated boiler feed water from the convection section of the pyrolysis furnace to the steam drum.

Some embodiments of the apparatus of the present invention may further comprise a line for recycling the cooled bottoms from the cooler to the vapor/liquid separator.

BRIEF DESCRIPTION OF THE DRAWING

The FIGURE illustrates a generalized schematic flow diagram of the overall process and apparatus in accordance with the present invention employed with a pyrolysis furnace.

DETAILED DESCRIPTION OF THE INVENTION

The present invention provides an efficient way of treating the liquid bottoms from a vapor/liquid separation apparatus associated with a hydrocarbon pyrolysis reactor used for steam cracking. The invention provides efficient recovery of heat from the separated resid or bottoms stream through indirectly heating boiler feed water with the resid bottoms stream. The heated boiled feed water is preferably used to make high pressure steam, more preferably high pressure steam that is consumed in the hydrocarbon pyrolysis system.

In one preferred embodiment, the steam and corresponding recovered heat is recovered, such as by cracked effluent quench and separated feed stock bottoms cooling, and is recycled back to the steam system for reuse in the steam cracking process. The boiler feed water can be preheated in a quench exchanger as the medium for indirectly cooling hot effluent from the pyrolysis reactor. This process recovers portions of the cracking heat from the pyrolysis furnace for recycle of the recovered heat to the pyrolysis system. The subsequent heat exchange between the preheated water and the separated feed bottoms may also recover still additional heat for recycle of that heat to the pyrolysis system. The recovered energy can be returned directly to the pyrolysis process. Such processes for heat recovery may vastly improve the total system efficiency of the pyrolysis steam cracking system, particularly with respect to cracking liquid, heavy, or resid-containing feedstocks, as compared to the heat recovery efficiency of previous pyrolysis systems.

The present invention is used in steam cracking of hydrocarbon feedstocks, especially liquid hydrocarbon feedstocks, e.g., those having a nominal final boiling point of at least about 315° C. (600° F.). These feedstocks typically contain non-volatile components.

As used herein, non-volatile components, or resids, are the fraction of the hydrocarbon feed with a nominal boiling point above 590° C. (1100° F.) as measured by ASTM D-6352-98 or D-2887. This invention works very well with feeds containing substantial quantities of non-volatiles having a nominal boiling point above 760° C. (1400° F.). The boiling point distribution of the hydrocarbon feed is measured by Gas Chromatograph Distillation (GCD) by ASTM D-6352-98 or D-2887. Non-volatiles may include (but are not limited to) coke precursors, which are large, condensable molecules that condense in the vapor, and then form coke under the operating conditions encountered in the present process of the invention.

Typical hydrocarbon feedstocks suited to use for steam cracking in the present invention are typically selected from the group consisting of steam cracked gas oil/residue admixtures, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gas/residue admixtures, hydrogen/residue admixtures, $C_4$'s/residue admixtures, naphtha/residue admixtures and gas oil/residue admixtures.

In applying this invention, the hydrocarbon feedstock preferably is initially heated by indirect contact with flue gas in a first convection section tube bank of the pyrolysis furnace before mixing with a fluxing fluid, e.g., steam. Following mixing with the primary dilution steam stream, the mixture stream may be further heated by indirect contact with flue gas, such as in the first convection section of the pyrolysis furnace, before being flashed and separated (e.g., such as flash separated in a vapor/liquid separation device) to separate the liquid phase from the volatized phase. The liquid stream may be referred to as the separated bottoms stream and the volatized stream as the separated overhead feed stream. Preferably, the first convection section is arranged to add the primary dilution flux or steam stream between subsections of the first convection section such that the hydrocarbon feedstock can be heated in the first convection section before mixing the steam with the feed. The feed-steam mixture stream then can be further heated before being flashed.

The temperature of the hot flue gas entering the first convection section tube bank is generally less than about 815° C. (1500° F.), for example, less than about 705° C. (1300° F.), such as less than about 620° C. (1150° F.), and preferably less than about 540° C. (1000° F.). After separation in the vapor liquid separator, the separated overhead feed stream is further heated, preferably in a second or lower portion of the convection section to permit. Dilution steam, however, may be added at any point in the convection heating process. For example, it may be added to the hydrocarbon feedstock before, during, or after heating in the first section. Any dilution steam stream may also comprise sour steam. Any dilution steam stream may be heated or superheated in a convection section tube bank located anywhere within the convection section of the furnace, preferably in the first or second tube bank.

The feed or feed-mixture stream may, for example, be at a temperature within a range of from about 260° C. (500° F.) to about 540° C. (1000° F.), preferably in a range from about 260° C. (500° F.) to about 480° C. (900° F.), and still more preferably in a range from about 425° C. (800° F.) to about 480° C. (900° F.), before or during introduction of the stream into the vapor/liquid separator or flash apparatus, e.g., knock-out drum. The flash pressure in the vessel, for example, may be about 275 to about 1380 kPa (40 to 200 psia). Following the flash of a heavy liquid feed, preferably 50 to 98 wt. % of the feed or feed-mixture stream that entered the separator may be in the overhead vapor phase. An additional separator process, such as a centrifugal separator and/or mist extractor, may be used to remove trace amounts of liquid or non-volatized components from the vapor phase. The vapor phase may be further fluxed and/or heated above the flash temperature, such as in the lower, hotter, second section of the convection section, before entering the radiant section of the furnace for cracking. The separated overhead stream may be heated, for example, to a temperature in a range of from about 425° C. to 705° C. (800° F. to 1300° F.). This heating may occur in a convection section tube bank, preferably the tube bank nearest the radiant section of the furnace (e.g., a second convection section). The feed is still further heated and cracked in the hot radiant section of the furnace. To prevent the cracking process from proceeding beyond generation of the desired product mix, the cracked effluent stream from the furnace must be quickly cooled or quenched.

According to the invention, a quench exchanger (such as a transfer line exchanger, dry exchanger, wet-wall exchanger, cold exchanger, or other exchanger) may be used to initially quench the cracked effluent stream. In some preferred embodiments, this quench exchanger is a dry wall exchanger that is indirectly cooled using boiler feed water. The indirectly heated quench water from the primary quench exchanger may then be directed to the separator to cool the separator bottoms (as discussed in more detail below) and/or otherwise used in production or use of steam. As discussed in more detail below, the cracked effluent stream may also be further quenched in secondary and/or tertiary quench exchangers, any or all of which may be indirectly cooled by boiler feed water. Preferably that boiler feed water is also used to subsequently cool the separated bottoms stream from the feed separator. In some alternative embodiments, the process could be reversed to cool the separated bottoms stream first and then use that water to quench the hot cracked pyrolysis effluent and generate steam therefrom.

In many embodiments, generated steam can be superheated in a convection section tube bank of the pyrolysis furnace, typically to a temperature less than about 590° C. (1100° F.), for example, about 450° C. (850° F.) to about 510° C. (950° F.) by indirect contact with the flue gas, preferably before the flue gas enters the convection section tube bank that is used for heating the heavy hydrocarbon feedstock and/or mixture stream. An intermediate desuperheater may be used to control the temperature of the high pressure steam. The steam is preferably at a pressure of about 4100 kPa (600 psia) or greater and preferably may have a pressure of from about 4100 kPa (600 psia) to about 10340 (1500 psia), or to about 11700 kPa (1700 psia), or even to about 13800 kPa (2000 psia). In some embodiments, the steam preferably may have a pressure ranging from about 8270 kPa (1200 psia) to about 10340 kPa (1500 psia). The steam superheater tube bank is preferably located between the first convection section tube bank and the tube bank used for heating the separated vapor phase.

In addition to recovering heat from the hot, cracked pyrolysis effluent stream, the present invention preferably recovers additional heat from the liquid bottoms of the vapor/liquid separation apparatus, using boiler feed water as a heat transfer medium in the recovery, which is ultimately converted to high pressure steam. Such conversion of the additionally heated high pressure boiler feed water to high pressure steam can be carried out in the transfer line exchanger, e.g., quench exchanger, as noted above.

The liquid bottoms from the vapor/liquid separation apparatus may typically have a temperature range from about 260° C. (500° F.) to about 540° C. (1000° F.) prior to cooling. The cooled liquid bottoms (after heat exchange with the boiler feed water) preferably may range from about 180° C. (350° F.) to about 315° C. (600° F.), more preferably from about 260° C. (500° F.) to about 315° C. (600° F.), and still more preferably from about 270° C. (520° F.) to about 290° C. (550° F.).

Preferably the boiler feed water is boiler feed water that is destined for the high pressure steam generation system. Prior to heating the boiler feed water in either the quench exchanger or in cooling the separated bottoms, the boiler feed water may have a boiler feed water temperature that ranges, for example, from about 90° C. (200° F.) to about 150° C. (300° F.), preferably from about 120° C. (250° F.) to about 150° C. (300° F.). As discussed previously, the boiler feed water is preferably preheated as quench media in a quench exchanger to cool the cracked effluent stream, preferably in a secondary or tertiary wet wall exchanger and/or more preferably in a quench-oil assisted and injected secondary and/or tertiary quench exchanger. As stated previously, in some embodiments, the boiler feed water may be preheated as exchange medium in a primary or other quench exchanger, such as in a dry-wall exchanger. The water may be preheated from the above mentioned boiler feed water introduction temperature to a temperature in a range of from about 150° C. (300° F.) to about 230° C. (450° F.), preferably from about 180° C. (350° F.) to about 200° C. (400° F.). Temperatures in these ranges have been found to perform well in subsequent cooling of separated bottoms liquid without causing undesirable viscosity increases in the separated bottoms.

After preheating the boiler feed water in the quench exchanger, the preheated boiler feed water (after heat exchange with the liquid bottoms) may have a temperature in a range from about 150° C. (300° F.) to about 230° C. (450° F.). In certain embodiments, the liquid bottoms from the vapor/liquid separation apparatus typically range from about 315° C. (600° F.) to about 480° C. (900° F.) and after heat exchange with the boiler feed water the cooled liquid bottoms range from about 260° C. (500° F.) to about 315° C. (600° F.).

Prior to heating the feed water in the quench exchangers, the supplied boiler feed water typically ranges from about 105° C. (220° F.) to about 140° C. (280° F.) and after heat exchange in the quench exchanger, the heated boiler feed water may have a temperature that ranges from about 150° C. (300° F.) to about 230° C. (450° F.), preferably from about 180° C. (350° F.) to about 200° C. (400° F.). After the boiler feed water has been heated in the quench exchanger, the boiler feed water may be considered "preheated" boiler feed water and boiler feed water that is heated via heat exchange with the separated bottoms from the vapor/liquid separator may be considered "heated" boiler feed water.

As discussed above, the present invention can utilize, as a source for high pressure steam boiler, feed water which has been preheated in a quench exchanger, such as in a transfer line exchanger, prior to additional heating by heat exchange with vapor/liquid separator bottoms. In particular, the present invention can be utilized in a method which comprises passing the hot cracked effluent through at least one primary transfer line heat exchanger, which is capable of recovering heat from the effluent. As needed, this heat exchanger can be periodically cleaned by steam decoking, steam/air decoking, or mechanical cleaning. Conventional indirect heat exchangers, such as tube-in-tube exchangers or shell and tube exchangers, may be used in this service.

In one embodiment, a primary heat exchanger cools the process stream, such as to a temperature between about 340° C. (640° F.) and about 660° C. (1220° F.), such as to about 540° C. (1000° F.), using boiler feed water as the cooling medium for subsequent use in generating high pressure steam. The primary transfer line exchanger (or primary quench exchanger) is typically a dry wall exchanger and cools the effluent only enough to prevent precipitation and deposition build-up of coke on the inner conducting surfaces.

Conveniently, a secondary quench exchanger, as well as, in some circumstances, a tertiary or supplemental secondary quench exchanger, (e.g., transfer line exchangers) may be provided and can be operated such that it includes a heat-exchanged effluent surface that is cool enough to condense part of the effluent and generate in situ a liquid hydrocarbon film at the heat exchange surface. The liquid film is preferably at or below the temperature at which tar is produced, typically at about 190° C. (375° F.) to about 315° C. (600° F.), such as at about 230° C. (450° F.). This is ensured by proper choice of cooling medium and exchanger design. Because the main resistance to heat transfer is between the bulk process stream and the generated film, the film can be at a significantly lower temperature than the bulk stream. The film effectively keeps the heat exchange surface wetted with fluid material as the bulk stream is cooled. The wetted surface film prevents deposition and adherence of the precipitates on the inner surfaces of the exchangers, thus preventing fouling. These additional secondary and tertiary transfer line exchangers are particularly suitable for use with light liquid feeds, such as naphtha, but may also be used for heavier liquid feeds. U.S. Patent Publication No. 2007/0007173, fully incorporated herein by reference, discloses use of a primary transfer line dry-wall heat exchanger to cool gaseous effluent and generate superheated steam, and at least one secondary transfer line heat exchanger having a liquid coating (provided by quench oil) on its heat exchange surface for additional cooling of the effluent while producing high pressure steam and/or preheating high pressure boiler feed water. Such an arrangement may be particularly advantageous for use in the present invention.

The gaseous effluent from the steam cracker furnace also can be subjected to direct oil quench, at a point typically between the furnace outlet and the separation vessel (primary fractionator) or tar knock-out drum. Such quench can be carried out in a secondary and/or tertiary transfer line exchanger as described above. The effluent temperature quench may also be effected by contacting or mixing the effluent with a liquid quench stream, in lieu of, or preferably in addition to, the treatment with transfer line exchanger type quench exchanges discussed above. Where employed in conjunction with at least one transfer line exchanger, the direct quench liquid is preferably introduced or injected at a point downstream of the primary quench exchanger. Suitable quench liquids include liquid quench oil, such as those obtained by a downstream quench oil knock-out drum, pyrolysis fuel oil and water, which can be obtained from various suitable sources, e.g., condensed dilution steam. Using a combination of direct quench oil injection plus the quench exchanger cooling using boiler feed water may serve to minimize the required amount of direct injection oil (which heat must be recovered downstream in a fractionator circulatory process thus removing that heat from the pyrolysis system) as compared to secondary quenching only with direct injection. The reduced amount of direct injected quench oil also results in a reduced amount of alienated heat that must be recovered in systems that likely will not return that heat to the pyrolysis system. Heat recovered in the boiler feed water may be returned to the pyrolysis system in the form of high pressure steam, while heat recovered outside of the high pressure steam system is not typically returned to the pyrolysis system. The inventive process greatly improves the overall pyrolysis system heat efficiency as compared to previous heat recovery systems that result in alienated heat. The inventive process also reduces the amount of direct injection quench oil required to cool the effluent as compared to quench exchanges only relying upon the injection oil to cool the effluent.

Thus, in certain preferred embodiments of the invention, the high pressure boiler feed water is an indirect heat transfer medium heated by a quench exchanger used to cool effluent taken from the radiant section of a pyrolysis furnace. The quench exchanger used as a source of boiler feed water for cooling liquid bottoms from the vapor/liquid separation apparatus is also typically a wet wall, secondary and/or tertiary quench oil-assisted exchanger.

After passage through the direct quench and/or transfer line heat exchanger(s), the cracked effluent has preferably been cooled to a temperature of less than about 315° C. (600° F.), more preferably to a temperature of less than about 290° C. (550° F.), and for some feeds such as some naphthas, to a temperature of less than about 260° C. (500° F.). The cooled, cracked effluent is fed to a tar separation vessel (such as a primary fractionator and/or at least one tar knock-out drum) wherein the condensed tar is separated from the cracked effluent stream. If desired, multiple knock-out drums may be connected in parallel, such that individual drums can be taken out of service and cleaned while the plant is operating. The tar removed at this stage of the process typically has an initial boiling point ranging from about 150° C. (300° F.) to about 315° C. (600° F.), typically, at least about 200° C. (400° F.). The quenched furnace effluent entering the primary fractionator or tar knock-out drum(s) should be at a sufficiently low temperature, typically at about 190° C. (375° F.) to about 315° C. (600° F.), such as at about 290° C. (550° F.), that the tar and condensables separate readily from the vapor phase. Heat contained in the cracked effluent stream to the tar separator/primary fractionator may be recovered by pumping the fluid through a separate heat exchange circuit and is typically exchanged to produce low pressure or medium pressure steam (e.g., less than about 4100 kPa (600 psia)). Although having uses, such heat recovery does not return the heat to the pyrolysis system where it typically has the highest value.

Quenching of the tar and condensables within the tar separation vessel in accordance with the invention can be accomplished by pumping a stream of tar taken from the bottom of the separation vessel through a tar cooler and recycling it to the separation vessel, e.g., the primary fractionator or tar knock-out drum. A portion of the tar product taken from a point downstream of the tar cooler may be recycled back to the tar knockout and/or primary fractionator to cool the condensables contained therein, and impede polymerization reactions. In the example, sufficient condensables are recycled to reduce the temperature in the tar separator bottoms or primary fractionator bottoms, for example, from a vessel inlet temperature range of about 280° C. (540° F.) to a vessel bottoms outlet temperature of about 150° C. (300° F.).

The tar cooler can be any suitable heat exchanger means, e.g., a shell-and-tube exchanger, spiral wound exchanger, airfin, or double-pipe exchanger. Suitable heat exchanger media for tar coolers include, cooling water, quench water and air. Sources of such media include plant cooling towers, and water quench towers. Typical heat exchange medium inlet temperatures for the tar cooler range from about 15° C. (60° F.) to about 120° C. (250° F.), e.g., from about 25° C. (80° F.) to about 105° C. (220° F.). Typical heat exchange medium outlet temperatures for the tar cooler range from about 40° C. (100° F.) to about 120° C. (250° F.), e.g., from about 50° C. (120° F.) to about 90° C. (200° F.). The heat exchange medium taken from the outlet can be used as a heating medium for other streams or cycled to the water quench tower or cooling tower.

Viscosity of the tar taken from the bottom of the separating vessel can be controlled by the addition of a light blend stock, typically added downstream of the pump used to circulate the steam cracker tar. Such stocks include steam cracked gas oil, distillate quench oil and cat cycle oil and are characterized by viscosity of less than about 1,000 centistokes (cSt), typically less than about 500 cSt, e.g., less than about 100 cSt. The gaseous overhead of the tar separation vessel/primary fractionator is directed to a recovery train for recovering valuable products, such as $C_2$ to $C_4$ olefins, inter alia.

Referring again to the preheated quench water used to quench the cracked effluent stream, the preheated quench water is preferably sent to an indirect heat exchanger to cool the separate bottoms from the hydrocarbon feed separator. The separated bottoms effluent stream is typically at a temperature of from about 260° C. (500° F.) to about 540° C. (1000° F.), and more typically at a temperature within a range of from about 260° C. (500° F.) to about 480° C. (900° F.), upon discharge from the vapor/liquid separator and is sent through a heat exchanger to cool the bottoms effluent. The separated bottoms stream is cooled preferably through indirect heat exchange with the boiler feed water, preferably the preheated boiler feed water, although other feed water sources may also be used to cool the separated bottoms effluent. The preheated boiler feed water, preferably high pressure boiler feed water, is typically at a temperature of at least about 150° C. (300° F.), preferably at least about 230° C. (450° F.), such as from about 180° C. (350° F.) to about 200° C. (400° F.).

After heat exchange, the cooled separated bottoms effluent may have a temperature within a range of from about 180° C. (350° F.) to about 315° C. (600° F.), preferably from about 260° C. (500° F.) to about 315° C. (600° F.), such as from about 270° C. (520° F.) to about 290° C. (550° F.). The heated boiler feed water may have a temperature within a range of from about 150° C. (300° F.) to about 230° C. (450° F.), preferably from about 180° C. (350° F.) to about 215° C. (420° F.), such as from about 195° C. (390° F.) to about 210° C. (410° F.). A portion of the cooled separated bottoms may be recycled into the liquid region of the hydrocarbon feed vapor/liquid separator to cool the collected liquid bottoms and prevent or mitigate tar and/or asphaltene growth. The heated boiler feed water is preferably then fed to the boiler/steam generator/steam drum, etc., (all terms are essentially the same and may be used interchangeably for this invention) for use in generation of high pressure steam. Heated boiler feed water may be liquid, vapor, or mixed phase. A portion of the heated boiler feed water can also be fed through the furnace convection section for superheating of such water, which may then be fed into the boil for steam generation.

In addition to the above described processes for cooling liquid bottoms from a vapor/liquid separator and corresponding process for cracking hydrocarbon feedstock containing resid, this invention also includes an apparatus and system for cracking hydrocarbon feedstock containing resid, using such inventive processes. The inventive apparatus and system for cracking a hydrocarbon feedstock containing resid includes at least (1) a convection heater for heating the hydrocarbon feedstock, such as the furnace convection section; (2) an inlet for introducing steam to the heated hydrocarbon feedstock to form a mixture stream, the inlet preferably also within the convection section; (3) a vapor/liquid separator for treating (e.g. flashing and separating) the mixture stream to form i) a vapor phase or overhead volatized stream and ii) a liquid phase or separated bottoms stream; preferably the separator further comprising an overhead outlet for removing the vapor phase as overhead and a liquid outlet for removing the liquid phase as separated bottoms from a liquid collection section of the vapor/liquid separator; (4) a cooler (e.g. indirect heat exchanger) for cooling the vapor/liquid separator bottoms by indirect heat exchange with boiler feed water, the cooler comprising an inlet for receiving the bottoms from the separator, a bottoms outlet for withdrawing cooled bottoms from the cooler, a boiler feed water inlet for receiving boiler feed water as a heat exchange medium to the cooler, and a boiler feed water outlet for withdrawing heated boiler feed water from the cooler for superheating and/or feeding to a steam drum; (5) a steam drum (e.g., a boiler/steam generator/steam drum), comprising an inlet for receiving the heated boiler feed water, and an outlet for withdrawing steam from the steam drum for use in the furnace pyrolysis cracking system; (6) a pyrolysis furnace comprising a radiant section for cracking the separated vapor phase to produce a cracked effluent comprising olefins; and (7) a means for quenching the cracked effluent and recovering cracked product therefrom, preferably quenched by the boiler feed water that will also be used for steam generation and preferably for also cooling the separated quenched bottoms. Typically, the means for quenching the cracked effluent includes a dry or wet walled quench exchanger, such as discussed above, that uses boiler feed water as an indirect quenching media. The boiler feed water inlet is supplied by heated boiler feed water that is preheated by the means for quenching the effluent.

In some embodiments, the steam drum is capable of providing steam of at least about 4100 kPa (600 psia), preferably at a pressure of from about 8270 kPa (1200 psia) to about 10340 kPa (1500 psia). Preferably, the means for quenching the effluent comprises a wet wall quench oil-assisted exchanger, and, preferably, the exchanger comprises at least one of secondary and a tertiary quench exchanger downstream from a primary quench exchanger.

According to some embodiments, the means for quenching the effluent uses boiler feed water, preferably high pressure boiler feed water, to quench the effluent and comprises a boiler feed water transfer line to transfer preheated boiler feed water from the means for quenching to the cooler feed water inlet as the boiler feed water. Preferably, the means for quenching the effluent comprises a dry wall exchanger, and, more preferably, a primary dry wall quench exchanger.

The inventive apparatus also includes, in some aspects, a line for introducing steam from the steam drum to the convection section, and a line from the convection section for withdrawing the steam from the convection section as superheated steam. The apparatus also preferably includes a line for introducing at least a portion of the heated boiler feed water from the cooler to the convection section of the pyrolysis furnace for additional heating, and a line for introducing the additionally heated boiler feed water from the convection section of the pyrolysis furnace to the steam drum. Some embodiments may also include a line for recycling the cooled bottoms from the cooler to the vapor/liquid separator.

Exemplary generalized embodiments of the invention will now be more particularly described with reference to the example shown in the accompanying drawing.

Referring to the FIGURE, a hydrocarbon feedstock 10, e.g., paraffinic crude oil, with or without a diluting fluid, e.g., steam and/or water, mixed with the feed, is introduced into a steam cracking furnace (pyrolysis reactor) 20 at the convection section 30 for preheating by a bank of exchanger tubes to vaporize a portion of the feedstock and to form a mist stream comprising liquid droplets comprising non-volatile hydrocarbons in volatile hydrocarbon/steam vapor. Further preheating of the feedstock/water/steam mixture can be carried out through a bank of heat exchange tubes (not shown).

As noted, the hydrocarbon feedstock is preheated in the upper convection section of the furnace. The feedstock may optionally be mixed with steam before preheating or after preheating (e.g., in a sparger). The preheating of the heavy hydrocarbon can take any form known by those of ordinary skill in the art. It is preferred that the heating comprises indirect contact of the feedstock in the convection section of the furnace with hot flue gases from the radiant section of the furnace. This can be accomplished, by way of non-limiting example, by passing the feedstock through a bank of heat exchange tubes located within the upper convection section of the pyrolysis furnace. The preheated feedstock has a temperature between about 315° C. (600° F.) and about 510° C. (950° F.). Preferably, the temperature of the heated feedstock is between about 370° C. (700° F.) and about 490° C. (920° F.), more preferably between about 400° C. (750° F.) and about 480° C. (900° F.), and most preferably between about 430° C. (810° F.) and about 475° C. (890° F.). The preheated mixture leaves the convection section and is introduced via line 40 into a vapor/liquid separation separator 50 wherein at least a portion of the liquid droplets is separated from the hydrocarbon vapor to form a vapor phase [e.g., for example, 66000 kilograms per hour (145000 pounds mass per hour)]. The vapor phase is taken as overhead via line 60 to the lower portion of convection section 30 and thence by crossover piping to the radiant section of the cracking furnace 70 in the presence of dilution steam [e.g., for example, 33000 kilograms per hour (72500 pounds per hour)]. Flue gas from the radiant section 70 is introduced to the lower portion of the convection section 30 whence it passes through the upper portion of convection section 30 and out of the furnace via outlet 80.

Hot gaseous pyrolysis effluent exits the lower portion of convection section 30 of steam cracking furnace 20 via line 90 into at least one primary transfer line heat exchanger 100 which cools the effluent from an inlet temperature ranging from about 705° C. (1300° F.) to about 925° C. (1700° F.), say, from about 760° C. (1400° F.) to about 870° C. (1600° F.), e.g., about 815° C. (about 1500° F.), to an outlet temperature ranging from about 315° C. (600° F.) to about 705° C. (1300° F.), say, from about 370° C. (700° F.) to about 650° C. (1200° F.), e.g., about 540° C. (1000° F.). The outlet temperature of this exchanger rises rapidly from about 440° C. (830° F.) to about 525° C. (980° F.), and then more slowly to about 550° C. (1020° F.). The furnace effluent may have a dew point of about 450° C. (850° F.). The effluent from the cracking furnace typically has a pressure of about 200 kPa (15 psia).

The primary quench exchanger 100 may comprise a boiler feed water inlet 110 for introducing high pressure boiler feed water ranging from about 4140 kPa (600 psia) to about 13800 kPa (2000 psia), say, about 10340 kPa (1500 psia), and having a temperature ranging from about 120° C. (250° F.) to about 340° C. (640° F.), e.g., about 315° C. (600° F.). High pressure steam or heated high pressure feed water at essentially the same pressure as the inlet boiler feed water is taken from steam outlet 120. After leaving the primary quench exchanger 100, the cooled effluent stream 130, e.g., 425° C. (800° F.) to 540° F. (1000° F.), is then fed to at least one secondary transfer line heat exchanger 140, where the effluent is further cooled on the tube side of the heat exchanger while boiler feed water is introduced via line 150 at about 120° C. (250° F.) and is thereby preheated (e.g., further heated) on the shell side of the heat exchanger, preferably according to an embodiment of this invention, in preparation for subsequently cooling the separated bottoms effluent, thereby being further heated, and used in the steam drum for regeneration of high pressure steam. In one embodiment, the heat exchange surfaces of the exchanger are cool enough to generate a liquid film in situ at the inner process surface of the quench exchanger tube, the liquid film resulting from condensation of the gaseous effluent. Thereby, deposition of condensables does not build up on the exchanger wall. Alternately, the secondary transfer line heat exchanger can be quench-assisted by introducing a limited quantity of quench oil, e.g., 20500 kg/hr (45000 lb/hr), via line 160, in a Quench/Feed ratio of 0.2-1.5 crude, 0.0 (LVN-Small Purge Only) using a suitable distribution apparatus, e.g. an annular oil distributor, to generate an aromatic-rich hydrocarbon oil film that fluxes away tar as the heaviest components of the furnace effluent condense. The mixture of furnace effluent and quench oil may be cooled to a quench exchanger outlet temperature of for example, about 345° C. (650° F.), generating additional 10400 kPa (1500 psia) steam taken off via line 170 or as heated boiler feed water via line 180 at 150° C.+ (300° F.+), say, 185° C. (365° F.) to 200° C. (390° F.).

On leaving the heat exchanger 140, the cooled gaseous effluent 190 pass to an additional secondary quench exchanger (or tertiary quench exchanger) 200 which can be quench-assisted by introducing a very limited quantity of quench oil, e.g., 6800 kg/hr (15000 lb/hr), via line 210, using a suitable distribution apparatus, say, an annular oil distributor, to generate an aromatic-rich hydrocarbon oil film that fluxes away tar as the heaviest components of the furnace effluent condense. A limited amount of quench oil is used in order to ensure a continuous oil film on the wall, given that the effluent has already been cooled below its dew point. The mixture of furnace effluent and quench oil is cooled to an outlet temperature of about 260° C. (500° F.) by preheating high pressure boiler feed water introduced via line 220 which is transferred via line 230.

Preheating high pressure boiler feed water in the quench exchanger(s) 200 is one of the most efficient uses of the heat generated in the pyrolysis unit, and this efficiency is further enhanced when such preheated water is subsequently used to cool the separated bottoms stream by indirect heat exchange. Following deaeration, boiler feed water is typically available at a temperature ranging from about 105° C. (220° F.) to about 150° C. (300° F.), say, from about 115° C. (240° F.) to about 140° C. (280° F.), e.g., about 130° C. (270° F.). Boiler feed water from a deaerator can therefore be preheated in the wet transfer line heat exchanger 140. All of the heat used to preheat boiler feed water will increase high pressure steam production. The quench system will generate for example, about 43200 kg/hr (95000 lb/hr) of 10450 kPa (1500 psia) steam which can be superheated to about 510° C. (950° F.).

On leaving the heat exchanger 200, the cooled gaseous effluent 240 is at a temperature, say about 290° C. (550° F.), or 260° C. (500° F.) (for light vacuum naphtha), where the tar condenses and is then passed into at least one tar separation drum or knock-out drum (not shown) where the effluent is separated into a tar and coke fraction and a gaseous fraction. The gaseous fraction can be further processed in a recovery train to provide light olefins.

Returning to the vapor/liquid separator 50, the liquid is removed as separated bottoms stream via line 250 at a temperature typically from about 260° C. (500° F.) to about 480° C. (900° F.), and thence introduced to vapor/liquid separator bottoms cooler 260 for indirect heat exchange with the boiler feed water. One of the highest energy values that can be recovered from the hot liquid bottoms from the vapor/liquid separator is where such bottoms can directly contribute to production of high pressure steam for use in the pyrolysis process. Because the vapor/liquid separator liquid should be cooled to a temperature below the saturation temperature of high pressure steam, to achieve full energy value the system should preheat boiler feed water, such as in the quench exchangers. Generally, high pressure boiler feed water is delivered to process units after deaeration, at a temperature of about 120° C. (250° F.). To avoid film temperatures sufficiently low to generate high viscosity in the cooled vapor/liquid separator bottoms, it is desired to preheat the boiler feed water to a temperature above about 150° C. (300° F.), and preferably to about 180° C. (350° F.) before it enters the vapor/liquid separator bottoms cooler. Thus, a source of boiler feed water can be provided to the bottoms cooler 260 via line 180. Preferably, the boiler feed water is delivered at deaerator outlet temperature to the final exchanger in the quench system. This exchanger is typically capable of preheating the boiler feed water to 180° C. (350° F.) to 200° C. (400° F.) where cracking crude oils, such temperatures being ideal for using high pressure boiler feed water as the cooling fluid in the vapor/liquid separator bottoms cooler.

Boiler feed water is heated in the bottoms cooler 260 to a temperature ranging from about 200° C. (390° F.) to about 210° C. (410° F.) and is thence removed via line 270 to steam drum 280 from which high pressure steam is taken via line 290 and routed to the convection section 30 of the furnace for superheating or wherever else high pressure steam is needed. Alternately, at least a portion of the heated high pressure boiler feed water from line 270 can bypass the steam drum and pass directly via line 300 to the convection section 30 where it is further heated and thence removed to the steam drum 280 via line 310. Superheated high pressure steam thus made can be taken from convection section 30 via line 320.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. A process for cooling liquid bottoms from a hydrocarbon feedstock vapor/liquid separation apparatus used in steam cracking said hydrocarbon feedstock, the process comprising:

indirectly heat exchanging said liquid bottoms with boiler feed water to provide cooled liquid bottoms and heated boiler feed water;

indirectly heat exchanging effluent from a radiant section of a stream cracking furnace in a quench exchanger used to cool said effluent from one of (i) prior to indirectly heat exchanging said liquid bottoms with said boiler feed water and (ii) after indirectly heat exchanging said liquid bottoms with said boiler feed water; and generating steam from the boiler feed water and recovering steam generated using said heated boiler feed water, the steam having a pressure of at least about 4100 kPa.

2. The process of claim 1, wherein said steam is used in a process of steam cracking said hydrocarbon feedstock.

3. The process of claim 1, wherein said liquid bottoms within the vapor/liquid separation apparatus range from about 260° C. to about 540° C. before cooling, said cooled liquid bottoms range from about 180° C. to about 315° C., and said heated boiler feed water may range from about 150° C. to about 230° C.

4. The process of claim 1, wherein said boiler feed water is an indirect heat exchange medium that is preheated by a quench exchanger used to cool effluent from a radiant section of a steam cracking furnace prior to indirectly heat exchanging said liquid bottoms with said boiler feed water.

5. The process of claim 1, which further comprises:

i) directing said steam from the steam drum to the convection section of a pyrolysis furnace; and ii) taking said steam from said convection section as a superheated steam.

6. The process of claim 1, further comprising recycling at least a portion of said cooled liquid bottoms to said vapor/liquid separation apparatus.

7. A process for cracking a hydrocarbon feedstock containing resid, the process comprising:

(a) heating a hydrocarbon feedstock containing resid;

(b) mixing the heated hydrocarbon feedstock with steam to form a mixture stream;

(c) introducing the mixture stream to a vapor/liquid separation apparatus to form i) a vapor phase of reduced resid content, and ii) a liquid phase of increased resid content, relative to the resid content of said mixture stream;

(d) separately removing each of the vapor phase as overhead and the liquid phase as bottoms from the vapor/liquid separation apparatus;

(e) cooling the bottoms by indirect heat exchange with boiler feed water to provide a heated boiler feed water and a cooled liquid bottoms;

(f) cracking the vapor phase in a radiant section of a pyrolysis furnace to produce a cracked effluent comprising olefins, the pyrolysis furnace comprising a radiant section and a convection section; and generating steam from the boiler feed water and (g) recovering steam generated using said heated boiler feed water, the recovered steam having a pressure of at least about 4100 kPa.

8. The process of claim 7, further comprising the step of preheating said boiler feed water by quenching said cracked effluent with said boiler feed water prior to cooling said bottoms by indirect heat exchange in step (e).

9. The process of claim 7, wherein said liquid bottoms within the vapor/liquid separation apparatus range from about 260° C. to about 540° C. before cooling, said cooled liquid bottoms range from about 180° C. to about 315° C., and said heated boiler feed water may range from about 150° C. to about 230° C.

10. The process of claim 8, wherein said step of quenching said effluent comprises quenching the effluent using the boiler feed water prior to indirectly heat exchanging said liquid bottoms with the boiler feed water in step (e).

11. The process of claim 7, wherein the heated boiler feed water is heated to a temperature range of from about 180° C. to about 230° C.

12. The process of claim 7, which further comprises:

i) directing said steam to the convection section of a pyrolysis furnace; and ii) taking said steam from said convection section as a superheated steam.

13. The process of claim 7, which further comprises:

directing at least a portion of said heated boiler feed water to the convection section of a pyrolysis furnace for additional heating of the heated boiler feed water, after which said additionally heated boiler feed water is used to produce said steam.

14. The process of claim 7, that further comprises recycling at least a portion of said cooled bottoms back to said vapor/liquid separation apparatus.

15. The process of claim 1, further comprising heating said heated boiler feed water in a quench exchanger used to cool effluent from a radiant section of a steam cracking furnace.

16. The process of claim 1, further comprising:

passing a mixture comprising hydrocarbons to a vapor/liquid separation apparatus to form i) a vapor phase of reduced resid content, and ii) a liquid phase of increased resid content, relative to the resid content of said mixture stream;

separately removing each of said vapor phase as overhead and said liquid phase as bottoms from said vapor/liquid separation apparatus;

cracking said vapor phase in a radiant section of a pyrolysis furnace to produce a cracked effluent comprising olefins, said pyrolysis furnace comprising a radiant section and a convection section; and passing said cracked effluent through one or more quench exchanger(s), wherein said boiler feed water is heated via indirect heat exchange in said quench exchanger by said cracked effluent.

17. The process of claim 16, wherein said one or more quench exchanger(s) comprise a primary quench exchanger and a secondary quench exchanger coupled in series with and downstream of said primary quench exchanger, wherein said secondary quench exchanger is utilized to heat said boiler feed water.

18. The process of claim 16, wherein said one or more quench exchanger(s) comprise a primary quench exchanger and a secondary quench exchanger coupled in series with and downstream of said primary quench exchanger, wherein said primary quench exchanger is utilized to heat said boiler feed water.

19. The process of claim 7, further comprising heating said heated boiler feed water in a quench exchanger used to cool effluent from a radiant section of a steam cracking furnace.

20. The process of claim 7, further comprising passing said cracked effluent through one or more quench exchanger(s), wherein said boiler feed water is heated via indirect heat exchange in said quench exchanger(s) by said cracked effluent.

21. The process of claim 20, wherein said one or more quench exchangers comprise a primary quench exchanger and a secondary quench exchanger coupled in series with and downstream of said primary quench exchanger, wherein said secondary quench exchanger is utilized to heat said boiler feed water.

22. The process of claim 20, wherein said one or more quench exchanger(s) comprise a primary quench exchanger and a secondary quench exchanger coupled in series and downstream of said primary quench exchanger, wherein said primary quench exchanger is utilized to heat said boiler feed water.

* * * * *